US006901239B2

(12) United States Patent
Ahn

(10) Patent No.: US 6,901,239 B2
(45) Date of Patent: May 31, 2005

(54) MEDIA REJECT DEVICE OF MEDIA DISPENSER

(75) Inventor: Jae Wook Ahn, Cheonan (KR)

(73) Assignee: LG N-SYS Inc., Seoul (KR)

( * ) Notice: Subject to any disclaimer, the term of this patent is extended or adjusted under 35 U.S.C. 154(b) by 0 days.

(21) Appl. No.: 10/721,322

(22) Filed: Nov. 26, 2003

(65) Prior Publication Data

US 2004/0105712 A1 Jun. 3, 2004

(30) Foreign Application Priority Data

Nov. 30, 2002 (KR) ..... 10-2002-0075675

(51) Int. Cl.[7] ..... G03G 15/00; B05H 31/26

(52) U.S. Cl. ..... 399/405; 399/107; 399/110; 399/410; 271/220; 271/222; 271/224

(58) Field of Search ..... 399/405, 410, 399/107, 110; 271/222, 220, 224

(56) References Cited

U.S. PATENT DOCUMENTS 5,896,974 A * 4/1999 Chang ..... 194/206
6,082,731 A * 7/2000 Yamazaki ..... 271/240
6,145,737 A * 11/2000 Imai et al. ..... 232/1 D
6,449,459 B2 * 9/2002 Tamehira et al. ..... 399/405
6,574,569 B1 * 6/2003 Omata et al. ..... 702/33
6,671,491 B1 * 12/2003 Yamanaka et al. ..... 399/407
2002/0053767 A1 * 5/2002 So ..... 271/10.01

* cited by examiner

*Primary Examiner*—Andrew H. Hirshfeld
*Assistant Examiner*—Marvin P. Crenshaw
(74) *Attorney, Agent, or Firm*—Birch, Stewart, Kolasch & Birch, LLP

(57) ABSTRACT

The present invention discloses a media reject device of a media dispenser including a media reject box being positioned in a receiving space of a main body and having a reject hole for inserting defective media, a door unit for opening/closing the reject hole, and a locking unit for unlocking the door unit when the media reject box is inserted into the receiving space, and locking the door unit when the media reject box is separated from the main body. The media reject device of the media dispenser consults user's convenience and prevents the media from being stolen.

9 Claims, 7 Drawing Sheets

MEDIA REJECT DEVICE OF MEDIA DISPENSER

This Nonprovisional application claims priority under 35 U.S.C. § 119(a) on Patent Application No(s). 10-2002-0075675 filed in KOREA on Nov. 30, 2002, the entire contents of which are hereby incorporated by reference.

BACKGROUND OF THE INVENTION

1. Field of the Invention

The present invention relates to a media dispenser, and more particularly, to a media reject device of a media dispenser which consults user's convenience and prevents media from being stolen by automatically locking a media reject box for rejecting defective media.

2. Description of the Background Art

In general, a media dispenser includes a media cassette for storing media, a media pick-up device for separating and discharging the media stored in the media cassette one by one, a media conveying device for conveying the media discharged from the media pick-up device, a media discharge device for externally discharging the media conveyed by the media conveying device, and a media reject device for rejecting defective media during the media transmission process.

As illustrated in FIG. 1, when defects are generated in the media conveyed by the media conveying device due to various factors, or when a few media are conveyed at a time, the conventional media reject device senses such defects and rejects the defective media. The conventional media reject device is comprised of a media reject box 106 inserted into a receiving space 104 of a main body 102, for storing the defective media, and a diverter 108 for diverting the defective media to the media reject box 106 by changing a media conveyance path when the media have defects.

A media reject hole 112 for inserting the media rejected through a media reject path 110 of the main body 102 into the media reject box 106 is formed on the media reject box 106, and a locking system is installed to open the media reject hole 112 when the media reject box 106 is inserted into the receiving space 104 of the main body 102, and to close the media reject hole 112 when the media reject box 106 is separated from the main body 102.

The locking system includes a door 114 rotatably mounted on one side of the media reject box 106 by a hinge shaft 128, for opening/closing the media reject hole 112, an operation rod 116 formed on the main body 102 and operated in the door opening direction when the media reject box 106 is inserted into the receiving space 104, and a locker 118 for locking the door 114 when the media reject box 106 is separated from the main body 102.

Here, a spring 120 is connected to one side of the door 114, for providing an elastic force to the door closing direction, and an operation lever 122 is installed to contact the operation rod 116 formed in the main body 102 and receive the pushing force of the operation rod 116. A through hole 126 which the operation rod 116 is inserted into is formed on the media reject box 106.

The operation of the locking system of the media reject box will now be explained. When the media reject box 106 is inserted into the receiving space 104 of the main body 102, the operation rod 116 passes through the through hole 126 and pushes the operation lever 122. The door 114 is rotated on the hinge shaft 128 to open the media reject hole 112, and thus the defective media are supplied to the media reject box 106.

When the media reject box 106 is separated from the main body 102, the door 114 returns to the original status by the elastic force of the spring 120 and closes the media reject hole 112. The user operates the locker 118 to lock the door 114.

In the locking system of the media reject box, when the media reject box 106 is separated from the main body 102, the door 114 is closed by the spring 120, and the user locks the door 114 by operating the locker 118. Accordingly, a special key is required to lock the door 114, which may trouble the user and cause theft of the media.

SUMMARY OF THE INVENTION

Therefore, an object of the present invention is to provide a media reject device of a media dispenser which consults user's convenience and prevents media from being stolen, by automatically locking a media reject box when it is separated from a main body.

To achieve these and other advantages and in accordance with the purpose of the present invention, as embodied and broadly described herein, there is provided a media reject device of a media dispenser, including: a media reject box being positioned in a receiving space of a main body and having a reject hole for inserting defective media; a door unit for opening/closing the reject hole; and a locking unit for unlocking the door unit when the media reject box is inserted into the receiving space, and locking the door unit when the media reject box is separated from the main body.

The door unit includes: a door panel movably arranged in the upper side of the media reject box, for opening/closing the reject hole; a locking lever connected to the door panel, for locking or unlocking the door panel according to the operation of the locking unit; and a return spring for providing an elastic force in the reject hole closing direction by the door panel.

First and second door panels of the door panel are linked to each other, and the locking lever is formed in a bar shape in the upper side of the media reject box to straightly move in the length direction, and has its one side connected to contact the locking unit and its other side linked to the door panel.

The locking unit includes: rotary plates rotatably mounted on both sides of the media reject box, for locking the locking lever; and fixed plates fixed to both sides of the receiving space of the main body, for rotating the rotary plates by interacting with the rotary plates.

The rotary plate is rotatably supported on the side of the media reject box by the hinge shaft, a spring for providing an elastic force to the rotary plate is installed on the hinge shaft, and a first magnet is installed on the front surface of the rotary plate.

The fixed plates are fixed to both sides of the receiving space, and second magnets are mounted on the front surfaces of the fixed plates, the same poles of the first and second magnets facing each other.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A media reject device of a media dispenser in accordance with the most preferable embodiment of the present invention will now be described with reference to the accompanying drawings.

Figure 1:
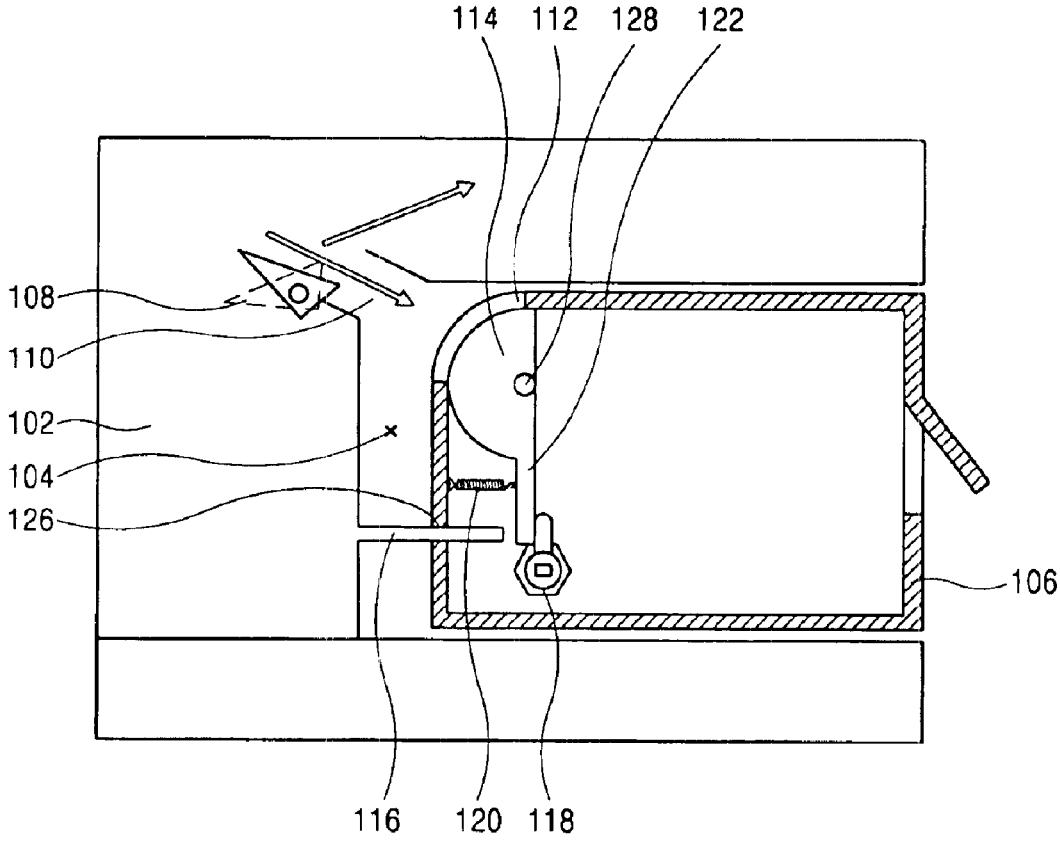
FIG. 1 CONVENTIONAL ART
FIG. 1 is a cross-sectional diagram illustrating a conventional media reject device of a media dispenser.
Figure 2:
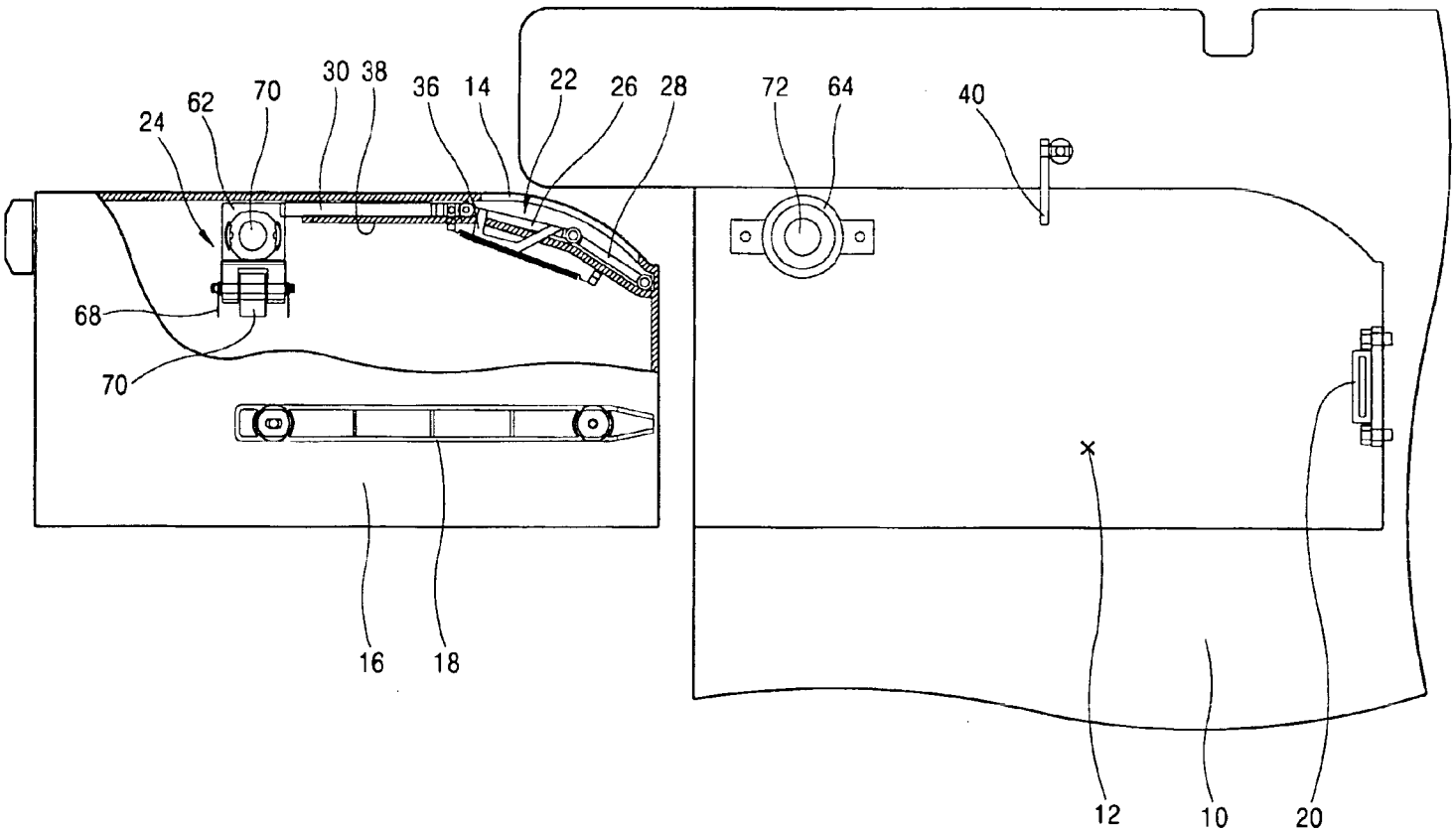
FIG. 2 CONVENTIONAL ART
FIG. 2 is a partially-cut side diagram illustrating a media reject device of a media dispenser in accordance with the present invention.
Figure 3:
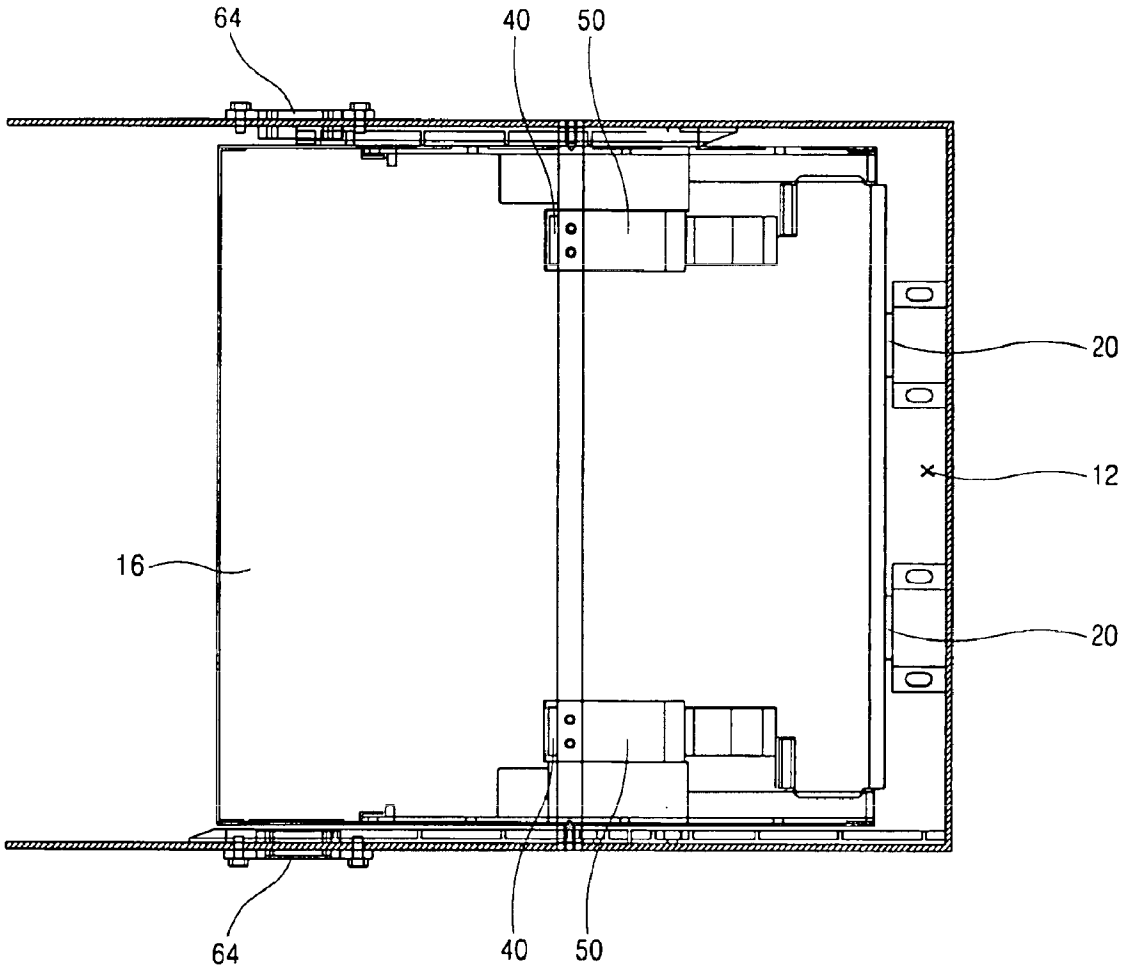
FIG. 3 is a top side diagram illustrating the media reject device in accordance with the present invention.

FIG. 2 is a partially-cut side diagram illustrating the media reject device of the media dispenser in accordance with the present invention, and FIG. 3 is a top side diagram illustrating the media reject device in accordance with the present invention.

The media reject device of the media dispenser includes a media reject box 16 being inserted into a receiving space 12 of a main body 10 and having a reject hole 14 for inserting defective media, and a locking system for opening the reject hole 14 when the media reject box 16 is inserted into the receiving space 12 of the main body 10, and locking the reject hole 14 when the media reject box 16 is separated from the main body 10.

Guide rails 18 for guiding the position of the media reject box 16 when the media reject box 16 is inserted into the receiving space 12 are installed on both sides of the media reject box 16, and the reject hole 14 is formed in a curved surface shape in the upper side of the rear side of the media reject box 16 so that the defective media can be easily inserted.

A fixing member 20 for fixing the position of the media reject box 16 in the receiving space 12 is mounted on the rear surface of the receiving space 12 of the main body 10. Preferably, the fixing member 20 includes a magnet mounted on the rear surface of the receiving space 12 for adhering the media reject box 16 by a magnetic force.

The locking system includes a door unit 22 for opening the reject hole 14 when the media reject box 16 is inserted into the receiving space 12, and closing the reject hole 14 when the media reject box 16 is separated from the main body 10, and a locking unit 24 for unlocking the door unit 22 when the media reject box 16 is inserted into the receiving space 12, and automatically locking the door unit 22 when the media reject box 16 is separated from the main body 10.

The door unit 22 includes door panels 26 and 28 arranged in the upper side of the media reject box 16 to be straightly movable, for opening/closing the reject hole 14, a locking lever 30 connected to the door panels 26 and 28, for locking or unlocking the door panels 26 and 28 according to the operation of the locking unit 24, and a return spring 32 installed between the door panels 26 and 28 and the media reject box 16, for providing an elastic force to the door panels 26 and 28 in the reject hole closing direction.

Here, the first door panel 26 and the second door panel 28 are linked to open/close the reject hole 14 formed in the curved surface shape, and the first door panel 26 is linked to the locking lever 30.

The locking lever 30 is arranged in the upper side of the media reject box 16 to be straightly movable, and formed in a predetermined length of circular bar shape having its one end connected to contact one side of the locking unit 24 and its other end linked to the first door panel 26.

Guide panels 38 are formed on the inside surfaces of both sides of the media reject box 16 in the length direction, for guiding the locking lever 30 and the door panels 26 and 28 to move in the length direction of the media reject box 16.

A hooking member 36 is mounted on one side of the first door panel 26, and a stopper 40 is mounted at a right angle on the top surface of the receiving space 12 of the main body 10. When the media reject box 16 slides into the receiving space 12 of the main body 10, the stopper 40 is hooked on the hooking member 36. Accordingly, when the door unit 22 is at a stationary state, if the media reject box 16 moves, the first and second door panels 26 and 28 open the reject hole 14.

Preferably, the stopper 40 is formed in two plate shapes arranged on the upper side of the media reject box 16, and a guide slot 50 for guiding the stopper 40 to be straightly movable is formed on the media reject box 16.

Figure 4:
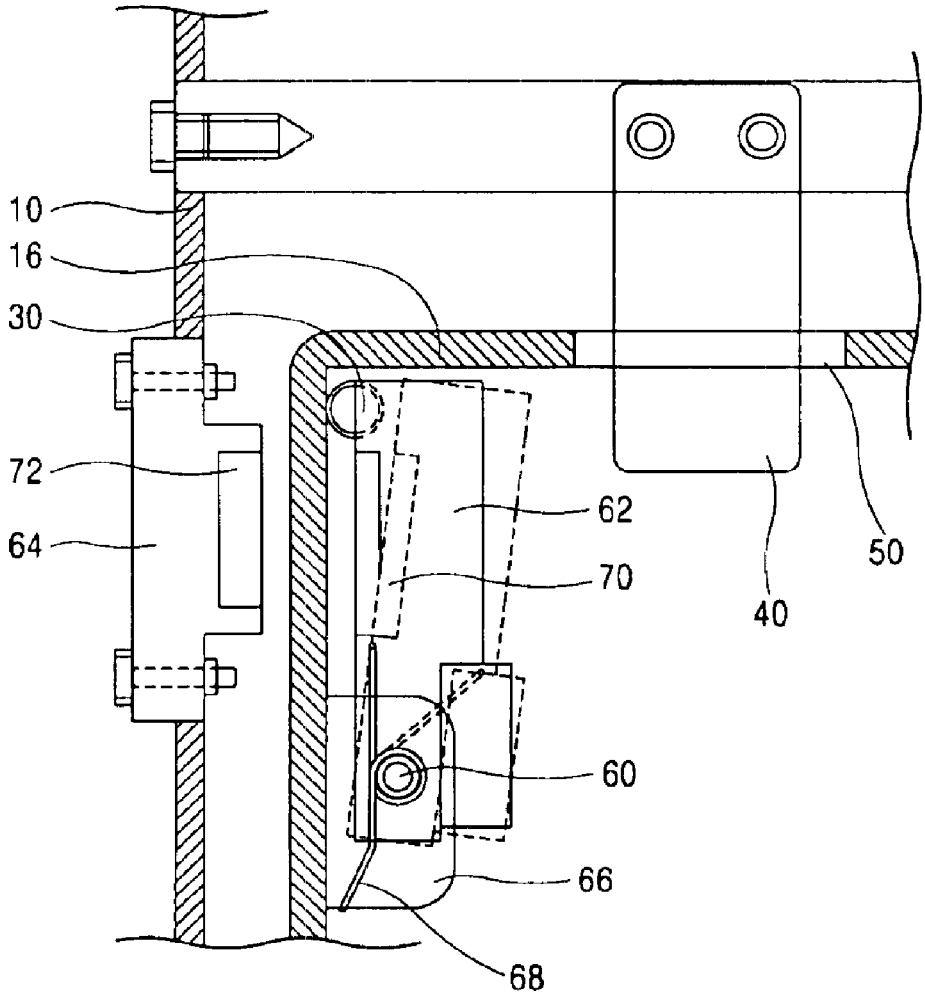
FIG. 4 is a cross-sectional diagram illustrating part of the media reject device in accordance with the present invention.

Referring to FIG. 4, the locking unit 24 is comprised of rotary plates 62 rotatably mounted on both sides of the media reject box 16 by a hinge shaft 60, for restricting motion of the locking lever 30, and fixed plates 64 fixed to both sides of the receiving space 12 of the main body 10, for rotating the rotary plates 62 when the rotary plates 62 are arranged to face the fixed plates 64.

Here, the rotary plate 62 is connected to a hinge bracket 66 fixed to the side of the media reject box 16 by the hinge shaft 60 and rotatably supported, a spring 68 is installed on the hinge shaft 60, for providing an elastic force to the rotary plate 62, and a first magnet 70 is installed on the front surface of the rotary plate 62.

The spring 68 is a coil spring wound up on the hinge shaft 60. One side of the spring 68 is supported on the hinge bracket 66, and the other side of the spring 68 is supported on the rotary plate 62. The spring 68 provides the elastic force in the direction of vertically standing the rotary plate 62, namely the direction of the rotary plate 62 restricting motion of the locking lever 30.

The fixed plates 64 are fastened to both sides of the receiving space 12, and second magnets 72 are mounted on the front surfaces of the fixed plates 64. Here, the same poles of the first and second magnets 70 and 72 face each other.

When the media reject box 16 is inserted into the receiving space 12 of the main body 10 so that the first magnet 70 and the second magnet 72 can face each other, the first magnet 70 and the second magnet 72 push each other.

Therefore, the rotary plate 62 overcomes the elastic force of the spring 68 on the hinge shaft 60, and is rotated to unlock the locking lever 30.

The operation of the media reject device of the media dispenser in accordance with the present invention will now be described.

Figure 5:
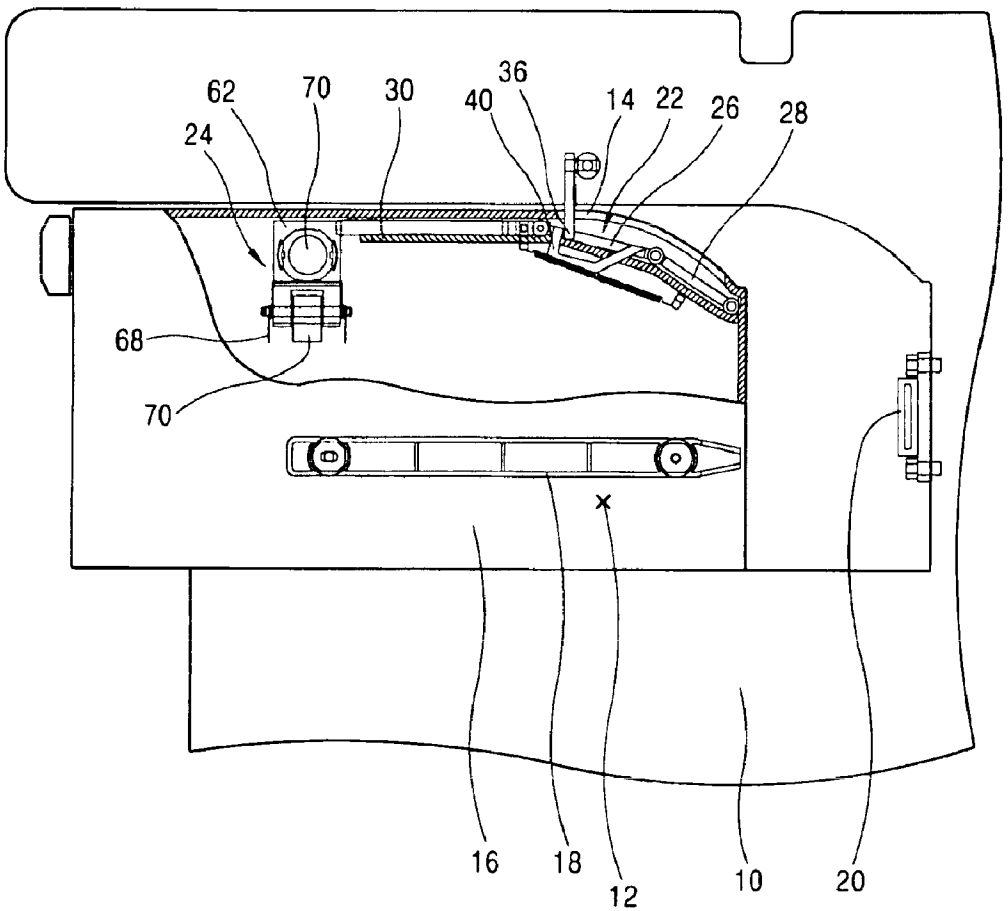
FIGS. 5 to 7 are operation status diagrams illustrating the media reject device in accordance with the present invention.
Figure 6:
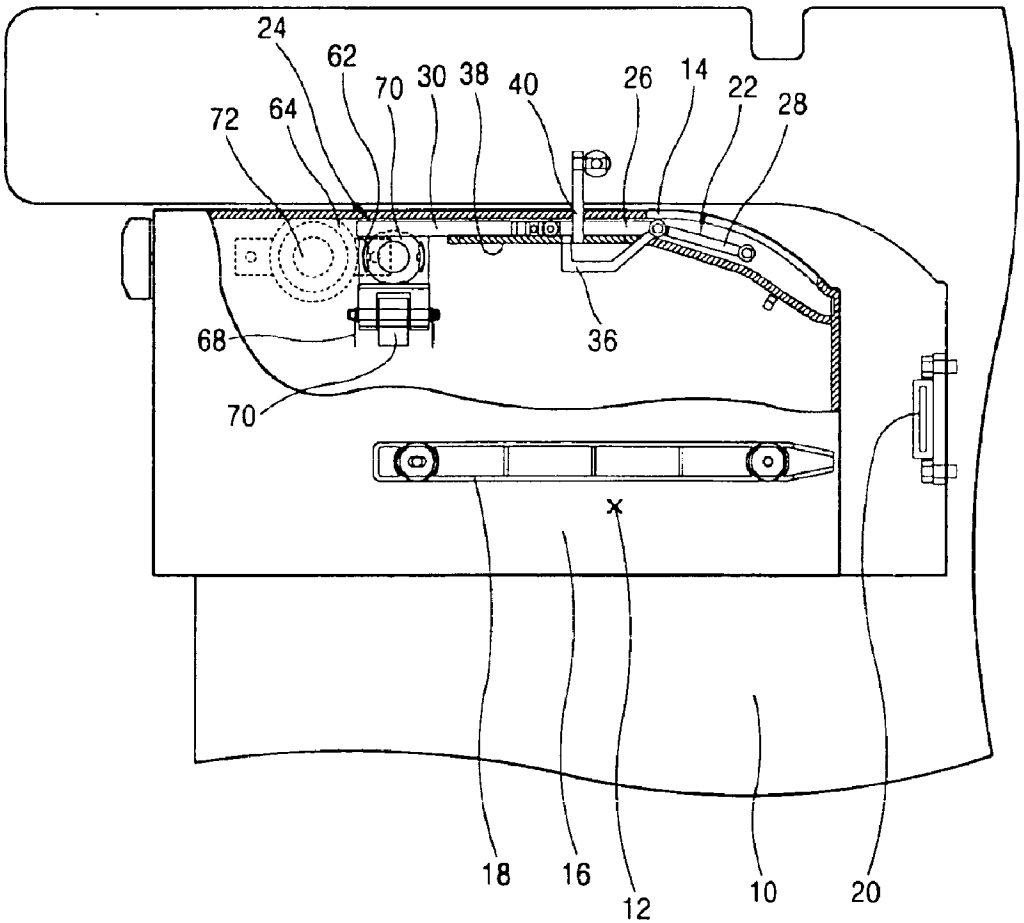
Figure 7:
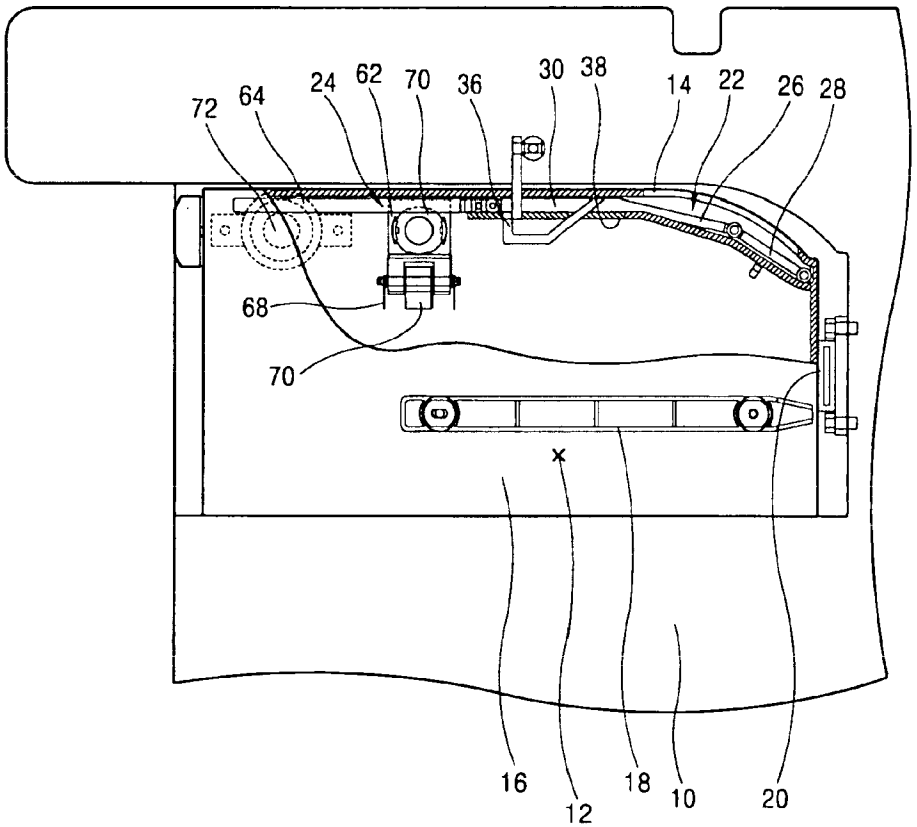

FIGS. 5 to 7 are operation status diagrams illustrating the media reject device in accordance with the present invention.

As shown in FIG. 5, when the media reject box 16 is slightly inserted into the receiving space 12 of the main body 10 so that the first magnet 70 and the second magnet 72 can face each other, the first magnet 70 and the second magnet 72 are arranged to have the same poles face each other, and thus push each other. Accordingly, the rotary plate 62 on which the first magnet 70 is mounted overcomes the elastic force of the spring 68 on the hinge shaft 60, and is rotated to unlock the locking lever 30 to be straightly movable. Here, the stopper 40 mounted on the top surface of the receiving space 12 is hooked on the hooking member 36.

In this state, as depicted in FIG. 6, when the media reject box 16 is more inserted, because the stopper 40 has been hooked on the hooking member 36, the first and second door panels 26 and 28 open the reject hole 14. Here, because the locking lever 30 has been unlocked, the locking lever 30 moves to the front side of the media reject box 16 with the first and second door panels 26 and 28.

As illustrated in FIG. 7, when the media reject box 16 is completely inserted, the magnet which is the fixing member 20 mounted on the rear side of the receiving space 12 adheres the media reject box 16 by the magnetic force, to fix the position of the media reject box 16. In addition, the first and second door panels 26 and 28 completely open the media reject box 16.

As described above, in a state where the media reject box 16 is inserted into the receiving space 12 of the main body 10, if the defective media are rejected and the user separates the media reject box 16 from the main body 10, as shown in FIG. 2, the first and second door panels 26 and 28 move to close the reject hole 14 by the elastic force of the return spring 32, the rotary plate 62 is vertically positioned and rotated by the elastic force of the spring 68 to lock the locking lever 30, and the first and second door panels 26 and 28 lock the closed reject hole 14.

The effects of the media reject device of the media dispenser will now be explained.

When the media reject box is inserted into the receiving space of the main body, the locking unit unlocks the door unit, and the door unit opens the reject hole to reject the defective media. When the media reject box is separated from the main body, the door unit closes the reject hole, and the locking unit locks the closed door unit. As a result, a special locking process is not necessary after separating the media reject box from the main body, thereby consulting user's convenience, and preventing the media from being stolen by the user.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A media reject device of a media dispenser, comprising:

a media reject box being positioned in a receiving space of a main body and having a reject hole for inserting defective media;

a door unit for opening/closing the reject hole;

a locking unit for unlocking the door unit when the media reject box is inserted into the receiving space, and locking the door unit when the media reject box is separated from the main body; and a fixing member for fixing the position of the media reject box in the receiving space installed in the receiving space of the main body, wherein the member is a magnet mounted on the rear surface of the receiving space, for fixing the media reject box by a magnetic force.

2. The media reject device of claim 1, wherein the door unit comprises:

a door panel movably arranged in the upper side of the media reject box, for opening/closing the reject hole;

a locking lever connected to the door panel, for locking or unlocking the door panel according to the operation of the locking unit; and a return spring for providing an elastic force in the reject hole closing direction by the door panel.

3. The media reject device of claim 2, wherein first and second door panels of the door panel are linked to each other.

4. The media reject device of claim 2, wherein the locking lever is formed in a bar shape in the upper side of the media reject box to straightly move in the length direction, and has its one side connected to contact the locking unit and its other side linked to the door panel.

5. The media reject device of claim 2, wherein the return spring is a coil spring having its one side mounted on the door unit and its other side mounted on the side of the media reject box, and providing the elastic force in the reject hole closing direction by the door unit.

6. The media reject device of claim 2, wherein the locking unit comprises:

rotary plates rotatably mounted on both sides of the media reject box, for locking the locking lever; and fixed plates fixed to both sides of the receiving space of the main body, for rotating the rotary plates by interacting with the rotary plates.

7. The media reject device of claim 6, wherein the rotary plate is rotatably supported on the side of the media reject box by a hinge shaft, a spring for providing an elastic force to the rotary plate is installed on the hinge shaft, arid a first magnet is installed on the front surface of the rotary plate.

8. The media reject device of claim 7, wherein the spring is a coil spring wound up on the hinge shaft, one side of which being supported on the hinge bracket, the other side of which being supported on the rotary plate.

9. The media reject device of claim 6, wherein the fixed plates are fixed to both sides of the receiving space, and second magnets are mounted on the front surfaces of the fixed plates, the same poles of the first and second magnets facing each other.

* * * * *